United States Patent [19]

De Lima Castro Neto

[11] 4,106,801

[45] Aug. 15, 1978

[54] ONE PIECE SECURITY SEAL AND NEW SEALING SYSTEM

[76] Inventor: Eduardo De Lima Castro Neto, Rua Sao Luiz Gonzaga 912, 20.000, Rio de Janeiro - RJ, Brazil, 20.000

[21] Appl. No.: 670,318

[22] Filed: Mar. 25, 1976

[30] Foreign Application Priority Data

Apr. 1, 1975 [BR] Brazil ..... PI-7501943

[51] Int. Cl.[2] ..... B65D 33/34

[52] U.S. Cl. ..... 292/307 R

[58] Field of Search ..... 292/307, 320, 321, 318, 292/316, 282; 40/10 D, 2.2

[56] References Cited

U.S. PATENT DOCUMENTS

| | | | |
|---|---|---|---|
| 1,049,381 | 1/1913 | Martineau | 292/282 |
| 2,809,065 | 10/1957 | Erke | 292/307 |
| 2,919,508 | 1/1960 | Stanley | 292/307 R X |
| 3,149,869 | 9/1964 | Chamberlin | 292/320 |
| 3,955,842 | 5/1976 | Edwards | 292/307 R |

*Primary Examiner*—Richard E. Moore

*Attorney, Agent, or Firm*—Beveridge, DeGrandi, Kline & Lunsford

[57] ABSTRACT

A new single piece plastic security seal comprising an insert which is elastically deformable on passing through an opening of slightly smaller dimensions, and a further part which may be broken away from said insert at a weakened region connecting the insert thereto. The seal is adapted for sealing two elements formed with openings in such a manner that the insert is passed through both openings to be caught behind the second one. The elements form a cavity for protecting the insert in the sealing position. The breaking of the weakened region permits the separation of the two elements in a direction normal to the axis of the openings.

11 Claims, 5 Drawing Figures

-1-

-1-

ONE PIECE SECURITY SEAL AND NEW SEALING SYSTEM

The present invention refers to a one piece security seal and a new sealing system.

Various systems are known in which two elements to be sealed together are adapted to receive a security seal which permits their separation only in the event of intentional or criminal violation of the seal. Two basic types of seals have been used previously, one being a single piece seal which is deformable by means of a tool (for example the extremely well known lead seal which is deformed over the two ends of a string closing a mailbag or the like) and a two piece seal in which one is inserted manually into the other (for example, the seals described in U.K. Pat. Nos. 1,312,300 and 1,400,760.)

An object of the present invention is to provide a one piece security seal which may be applied to the two elements to be sealed without the necessity of using a tool to deform the seal over the said elements.

Another object of the invention is to provide a seal of the above type which is easily broken for separating the two elements, said one piece seal being the only part which is destroyed. In this respect, it should be observed that when a mailbag or the like sealed with a lead seal is opened it is necessary to cut the string which is later thrown away. The same situation exists with the seal described in the U.K. Pat. No. 1,312,300. U.S. patent application Ser. No. 517,350 describes a label holder which may be used with a security seal similar to that disclosed in U.K. Pat. No. 1,312,300and which has the advantage of permitting a mailbag to be closed in such a way that, on breaking the seal, the latter, comprising a capsule and an insert, is the only element which is lost whereas the string and the label holder may both be used many times. When the one piece seal of the present invention is used with a duly modified version of the above mentioned label holder, the only element to be thrown away is the single piece seal. Apart from this, the seal of the present invention is very simple to use since it may be applied with a light manual pressure.

In accordance with the present invention a security seal comprises a single element consisting of an insert portion which is elastically deformable and fixed by means of a weakened region to a second portion which is removable by breaking said weakened region. Preferably the insert portion has a rectangular base, a central part extended perpendicularly from the middle of said base and, on the two opposie sides of the free end of the central part, two elastically deformable arms inclined outwardly and backwardly towards the base, the second portion comprising a blade having a width approximately equal to that of the base and being connected thereto by said weakened region.

According to another aspect of the present invention, a sealing system comprising two elements to be sealed together in which the first comprises a first part provided with a first opening therethrough and the second element comprises a second part provided with a second opening, said two openings being alined in the sealing or closed position of the two elements in which position the two elements define a closed cavity behind said second opening on the side of the second part remote from the first part, said cavity having a larger cross-section than that of the second opening at least in the region of the latter, the cavity being accessible from the outside only through said two alined openings when in the sealing position and freely accessible when the two elements are separated; and a security seal of the above defined type in which the insert portion is capable of passing through said two openings, undergoing elastic deformation on passing through second opening and then becoming caught behind the second opening and within said cavity, the weakened region of the seal, in the sealing position, being behind said first opening, that is to say, on its side associated with said cavity.

As has already been mentioned in the specification, the security seal and the sealing system are most suitable for use with the label holder described in U.S. Ser. No. 517,350 and the invention can therefore be described in connection with such label holder, reference being made to the attached drawings, in which.

Figure 1:
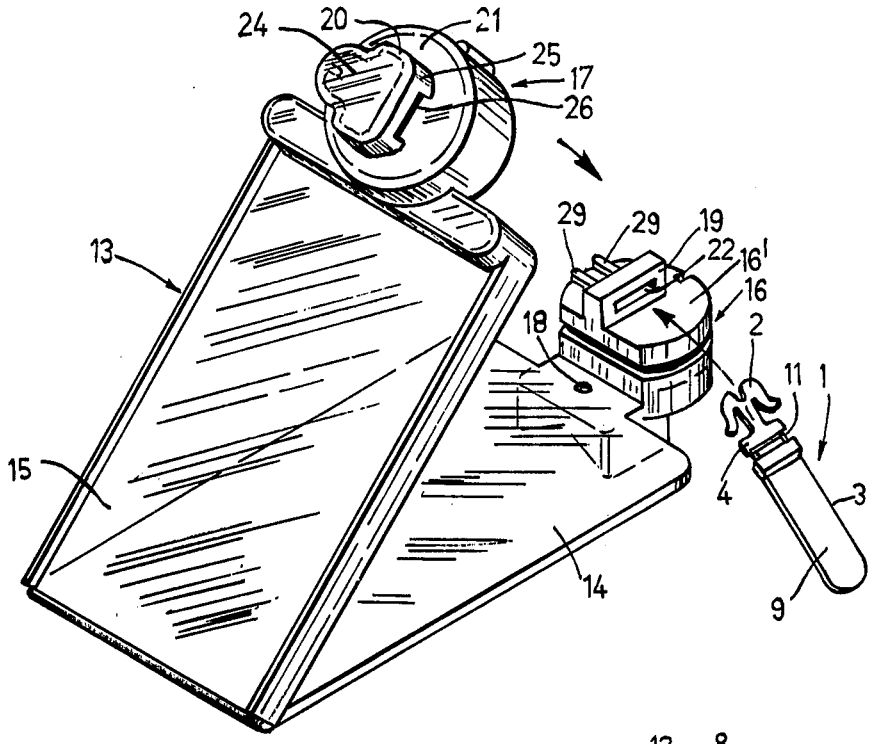
FIG. 1 is a perspective view of a label holder and security seal constructed in accordance with the invention.
Figure 3:
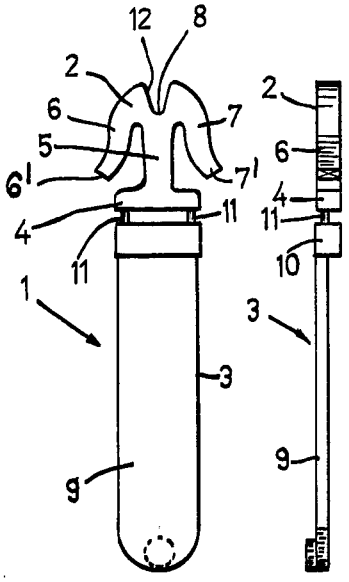
Figure 4:
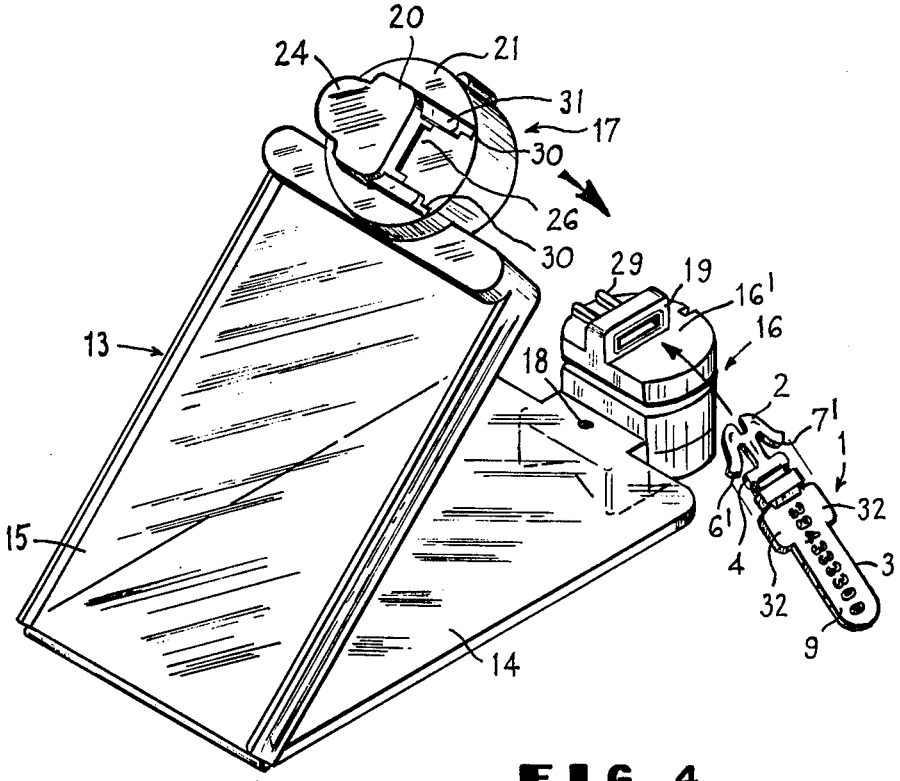
Figure 5:
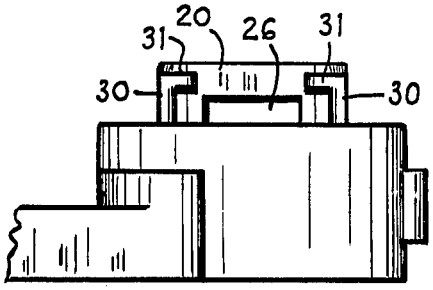

FIG. 3 comprises two orthographical views of the new single piece seal;

FIG. 4 is a perspective view similar to FIG. 1, showing a modified version of a label holder and seal constructed in accordance with the invention; and FIG. 5 is a front view of the capsule and cap portions shown in FIG. 4.

Referring now to the drawings, FIG. 1 shows a moulded plastic label holder to be sealed by the new single piece seal 1 which is shown in detail in FIG. 3. Seal 1 comprises an insert portion 2 and a removable portion 3. The insert 2 has a rectangular base 4, a central part 5 extending from the middle of the base perpendicular thereto and two arms 6 and 7 beginning on opposite sides of the free end 8 of the central part 5 and extending outwardly and backwardly in the direction of the base.

The removal portion 3 of the new seal comprises a blade 9 having a thicker rectangular base end 10 of the same thickness as the insert portion 2. The base end 10 is fixed to the base 4 of the insert by a weakened joint, such weakening being represented in the illustrated seal by two small bridges 11.

Seal 1 is moulded from plastic material so as to give arms 6 and 7 a certain flexibility for permitting them to be elastically deformed when one applies the seal to a sealing system. As shown in FIG. 1 the flexibility of arms 6 and 7 is facilitated by the existence of a small longitudinal recess 12 at the free end 8 of the central part 5 of the insert.

The plastic material from which the seal is manufactured is preferably polypropylene.

FIG. 1 is a perspective view of a moulded plastic label holder 13 which is basically similar to that illustrated in U.S. Ser. No. 517,350 for which reason only a short description of its basic structure will be given here. As illustrated the label holder 13 comprises two integrally moulded parts 14 and 15 which are foldable one over the other and adapted to receive a paper label when in the closed position. Part 14 is integral with a fixed spool 16 whereas part 15 is integral with a cap 17 which fits over spool 16 when the label holder is closed. One end of a piece of string may be fixed in a hole 18 in part 14, the string being wound around the neck of a mailbag or the like and then around the spool before closing the parts 14 and 15. The present invention however refers only to the new system for sealing the cap 17 over the spool 16, such differing substantially from that described and illustrated in the above mentioned prior patent application.

The sealing system basically comprises a wall 19 moulded on the upper surface 16' of spool 16 and a "capsule" 20 formed in the upper part or top 21 of cap 17. Wall 19 is provided with a rectangular through opening 22 having a height slightly greater than the thickness of said insert 2 and a width somewhat less than the separation between the ends 24 of the arms 6 and 7 on the insert and slightly larger than the width of base 4. Consequently insert 2 may pass through opening 22 by means of elastic deformation (compression) of arms 6 and 7. Behind opening 22 two shoulders 23 are inclined at an angle which corresponds substantially to the inclination of the end surfaces 6' and 7' of arms 6 and 7 in the non-deformed condition. These shoulders 23 are clearly shown in FIG. 2.

The "capsule" 20 is open on the inner or under side so as to be accessible from the interior of cap 17. The upper side of the capsule is closed by the top 24, the capsule also having a side wall 25 which is provided with an opening 26 having substantially the same dimensions as opening 22 and adapted to be alined therewith when the label holder 13 is closed with spool 16 covered by cap 17. The shape of side wall 25 and of the capsule top 24 is not extreme importance provided that when the cap is closed over the spool an internal cavity 27 is formed having a size sufficient to receive insert 2, the only possible access being through alined openings 22 and 26. In the illustrated embodiment, the shape of the capsule generally corresponds to that of insert 2 and the side wall 25 is provided with a small vertical internal rib 28 which extends into recess 8 of insert 2 when in the sealed position.

Figure 2:
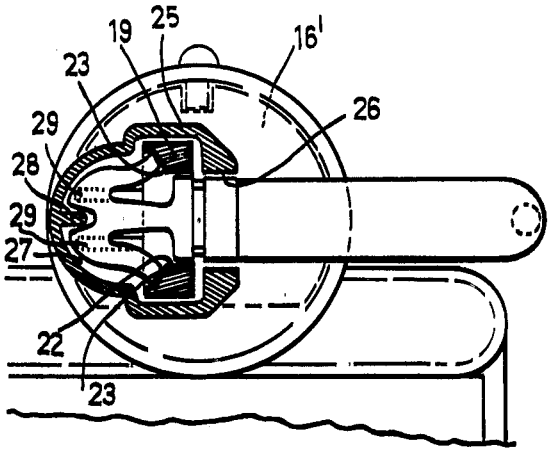
FIG. 2 is a plan view of part of the label holder closed in the seal, the sealing system being illustrated in section.

As can be seen from FIG. 2, when the label holder 13 is closed with spool 16 fitted into cap 17, wall 19 enters the capsule and opening 22 becomes positioned adjacent and behind opening 26. It will be observed that the upper surface 16' of the spool closes capsule 20 serving as a bottom therefor and ensuring that the only access to the internal cavity 27 is by means of the two openings 22 and 26. Once wall 19 has entered capsule 20, the single piece seal 1 may be applied to the system by inserting the insert through the two openings 22 and 26. This is only possible by the elastic compression of arms 6 and 7 which, on reaching the shoulders 23, open once more so as to become engaged behind said shoulders in such a way that insert 2 remains within cavity 27 in the capsule. Base 4 of the insert remains inside opening 22 preventing access of any other element therethrough. Equally the base end 10 of blade 9 fills opening 26 in wall 25 which makes cavity 27 even more secure against any attempt of violation. The two weakened bridges 11 of seal 1 are disposed in the gap between the two openings 22 and 26.

FIG. 2 shows the seal already applied to the system which is sealed in a secure and inviolable manner. It should be observed that the insertion of insert 2 in cavity 27 is an extremely simple operation. It merely being necessary to hold the blade 9 and force the insert through the openings 22 and 26. The force necessary is small since arms 6 and 7 are reasonably flexible, whereby the seal applying operation can be carried out in a matter of seconds. The flexibility of arms 6 and 7, however, in no way detracts from the security of the system since any tractive force applied in a direction to withdraw insert 2 tends to open arms 6 and 7, this making their engagement behind shoulders 23 even more positive.

The operation of opening the label holder is also extremely simple. It is only necessary to grip blade 9 and pull it outwardly and laterally, thus breaking the bridges 11 and removing the blade, insert 2 remaining within the cavity 27. Having removed blade 9, it is possible to raise cap 17 and open the label holder. The insert 2 is then left lying on the upper part of spool 16 and may be simply removed. The string (not shown) may now be unwound from spool 16 and from the neck of the mailbag thus leaving both the label holder itself 13 and the string in perfect condition for re-use. The only element to be thrown away is the seal 1.

With a view to further improving the system, the upper surface 16' of the spool is formed with two ribs 29 having a height equal to that of the bottom surface of opening 22 in wall 19 thus ensuring that the insert be horizontally supported within cavity 27. Obviously said height is equal to the thickness of the top 21 of cap 17 so that the upper surface of said top 21, the bottom surfaces of openings 22 and 26 and the upper surfaces of ribs 27 are all in the same plain when the device is closed.

Finally, although bridges 11 are positioned in the gap defined between openings 22 and 26 so as to permit the label holder to be opened when they are broken, it will be understood that such weakening could equally be positioned within opening 22 or even within cavity 27 provided that the broken part may be removed to permit opening of the device. It is not possible however to position the weakening within opening 26 in the capsule since the breaking of the seal would simply remove blade 9, the spool and cap remaining sealed together.

Referring now to FIGS. 4 and 5 there is shown a label holder and seal identical to FIGS. 1 to 3 as regards the basic structure but incorporating preferred aspects which have been shown in tests to be of particular utility. The reference numerals used in FIG. 1 all appear in FIG. 4. In accordance with this preferred embodiment, on either side of opening 26 in the capsule 20 there is a guard wall 30, the two guard walls defining a passage through which the insert 2 of the seal passes before entering the capsule. The two walls 30 are preferably separated by a distance slightly greater than the separation of the free ends 6' and 7' of arms 6 and 7 of seal 1, in the undeformed condition. This ensures that there will be no difficulty in applying the seal due to the necessity to force it along the passage defined by walls 30.

Although it would be possible to make walls 30 as planar structures extending upwardly from top surface 21 of cap 17, it is preferable to give them an L section as shown in FIG. 4, one of the limbs 31 of the L being parallel to surface 21. It should be noticed that the limbs 31 are separated from each other by a distance approximately equal to the width of blade 9 of seal 1 since this permits perfect visibility of the upper surface of the blade which in practice, for security purposes, will be moulded with an individual identification number.

As for the seal itself in FIG. 4 it will be observed that it has two lateral widenings or wing-like portions 32 in that region of blade 9 which will be positioned between the guard walls 30 in the sealing position of the device. The total width of the blade 9 in the region of widenings 32 is preferably identical to that of the separation between the free ends 6' and 7' of arms 6 and 7 of insert 2 or, in other words, slightly less than that spacing between guard walls 30. In addition, in order to avoid the accumulation of stresses in blade 9 where it joins its base end 10, the seal 1 shown in FIG. 4 is formed with a chamfer 33. This prevents any possibility of the seal breaking in the wrong place when opening the label holder.

It should be observed here that in the absence of guard walls 30 and widenings 32, there is always the possibility of accidental fracture of the weakened region 11 of the spool during transport. The presence of these additional characteristics, however, ensures protection against such accidental opening of the seal. The seal shown in FIG. 4 has therefore been found to be much more preferable than that of FIGS. 1 to 3.

It will be understood by those versed in the art that the new seal may be used in sealing systems which are different from that described with respect to the label holder. The new seal may be applied in any situation in which two elements to be sealed have, in the closed position, two alined openings and an insert receiving cavity to which access is only possible by means of said openings, it being equally essential that the cavity be easily accessible when the elements are separated so as to make it possible to remove the insert which was separated from the blade to permit opening of the system. One example of a modification of the system would be in the case of sealing a box comprising two open ended boxes which telescope into each other. The larger box which surrounds the other in the telescoped position would have a protuberance in one side wall near the open end, said protuberance being formed with an opening in a direction normal to the longitudinal axis of the box. Near the closed end of the other box, one lateral wall will be provided with an outwardly protruding portion moulded in a manner somewhat similar to the "capsule" shown in FIG. 1. This capsule would have a slit longitudinally of the box into which the protuberance in the first box may be inserted. The capsule would also have a lateral opening which would become alined with said protuberance. This arrangement would allow the application of the new single piece seal through the two alined openings.

I claim:

1. Single piece security seal comprising (a) a first insert portion comprising a rectangular base, a central part extending perpendicularly from the middle of said base and, on the two opposite sides of the free end of said central part, two elastically deformable arms inclined outwardly and backwardly towards said base with a maximum separation between said arms in the undeformed condition which is greater than the corresponding width dimension of said rectangular base;

(b) a second removable portion comprising a blade alined with said central part and provided with a rectangular base having a width and thickness substantially equal to those of said insert portion base; and (c) weakened breakable means connecting said bases.

2. Sealing system comprising first and second elements to be sealed together in which said first element comprises a capsule defining part having a first and second openings therein, said second opening being larger than said first opening, and said second element on being moved substantially in the plane of said first opening closes said second opening in a closed position of said system, said second element being provided with a wall part which in said closed position is disposed in the interior of said capsule behind said first opening and said wall part being formed with a third opening, also smaller than said second opening, which is aligned with said first opening in said closed position, and a single piece security seal comprising:

(a) a first insert portion comprising a rectangular base, a central part extending perpendicularly from the middle of said base and, on the two opposite sides of the free end of said central part, two elastically deformable arms inclined outwardly and backwardly towards said base with a maximum separation between said arms in the undeformed condition which is greater than the corresponding width dimension of said rectangular base, said base having a cross section slightly smaller than that of said third opening;

(b) a second removable portion comprising a blade aligned with said central part and provided with a rectangular base having a width and thickness at least equal to those of said insert portion base, said removable portion base having a cross section slightly smaller than that of said first opening; and (c) weakened breakable means connecting said bases.

3. Sealing system according to claim 2 in which said second element comprises a generally cylindrical spool-like member having a peripheral string receiving groove in the cylindrical side wall thereof, said spool-like member having a top surface with said wall part upstanding therefrom; and in which said first element comprises a cap adapted to cover said spool-like member including said groove, said cap having a cavity open at its bottom to define said second opening.

4. Sealing system according to claim 3, in which said first element further comprises a first half of integral label holder having one end integralf with said cap and said second element further comprises a second opposite half of said label holder having one end integral with said spool-like member, said first and second halves being adapted for receiving a label therebetween in a closed position with said second half placed over said first half and said cap placed over said spool.

5. Security seal according to claim 1 in which the said free end of the central part is formed with a longitudinal recess.

6. Security seal according to claim 1 in which said blade is provided with lateral widenings or wings in the region of said base end.

7. Sealing system according to claim 3, in which said third opening is formed internally on its rear side facing said cavity with two inclined shoulders.

8. Sealing system according to claim 3 including at least one rib formed on said top surface of said spool-like member, said rib having a height substantially equal to that of said second opening with respect to said top surface of said spool-like member.

9. Sealing system according to claim 3 comprising a vertical internal rib on said side wall on a capsule in a position diametrically opposite said first opening and a recess in said free end of said central part of said seal.

10. Sealing system according to claim 3, in which said first opening is flanked by two upstanding parallel guard walls extending away from said capsule parallel to the axis of said opening, said second portion of said seal being provided with widenings or wings, the width of said second portion in the region of said widenings being slightly less than the separation between said guard walls.

11. Sealing system according to claim 10, in which said walls have an L section, one limb of the L of each wall substantially overlying said widenings when said seal is in the sealing position.

* * * * *